United States Patent [19]

Barnes

[11] Patent Number: 4,881,780

[45] Date of Patent: Nov. 21, 1989

[54] SECURING DEVICE AND METHOD FOR HOLDING A CHILD UPRIGHT ON A SWING SEAT

[76] Inventor: Graciela Barnes, 4566 El Carro La., Carpinteria, Calif. 93013

[21] Appl. No.: 239,800

[22] Filed: Sep. 2, 1988

[51] Int. Cl.[4] ..... A47C 31/00; A47C 3/02

[52] U.S. Cl. ..... 297/467; 297/275

[58] Field of Search ..... 297/465, 468, 466, 467, 297/275, 274

[56] References Cited

U.S. PATENT DOCUMENTS

| | | | |
|---|---|---|---|
| 921,057 | 5/1909 | Ayers | 297/275 |
| 1,837,983 | 12/1931 | Moran | 297/465 |
| 2,852,066 | 9/1958 | Hawkins | 297/275 X |
| 3,099,486 | 7/1963 | Scott | 297/465 |

*Primary Examiner*—James T. McCall

[57] ABSTRACT

A securing device for holding a child upright on a moving swing seat has an elongated panel of flexible cloth material with an intermediate portion is extendable in forward-and-aft relation below the swing seat and front and rear portions connected to and extending in opposite directions from the intermediate panel portion. The front and rear panel portions are extendable upwardly from the front and rear of the swing seat and along the front and rear of the child seated thereon. An elastic strap attached on the intermediate panel portion is extendable forward-and-aft relation over the swing seat for anchoring the intermediate panel portion under the swing seat. A snap fastener with matable parts on the strap and intermediate panel portion is provided for detachably attaching the strap thereto. Front and rear tie members attached to respective outer ends of the front and rear panel portions at the arm pit level of the child are extendable about the child and the chains supporting the swing seat for coupling the front and rear panel portions thereto. Also, the front and rear tie members are adapted to form knots at opposite rear and front sides of the child for retaining the front and rear panel portions in generally vertically-extending relation at the respective front and rear of the child for holding the child upright on the swing seat as the seat and child therewith undergo swinging motion.

12 Claims, 2 Drawing Sheets

SECURING DEVICE AND METHOD FOR HOLDING A CHILD UPRIGHT ON A SWING SEAT

BACKGROUND OF THE INVENTION

The present invention relates generally to child restraint devices and, more particularly, is concerned with a securing device and method for holding a child in an upright position on a swing seat.

Swinging back and forth in a swing is usually a most enjoyable activity for a young child. It can provide an exciting experience for the child but can be a stressful experience for the parent or other person doing the pushing. For a small child to use a standard swing, it is necessary to hold on to the child while swinging him or her. These tasks are awkward and tiring to perform simultaneously, making it easy for accidents to happen.

The prior art is replete with devices designed for the purpose of supporting, holding or restraining a child on a high chair. Representative of the prior art are the devices disclosed in U.S. Pat. Nos. to Peck (1,205,384), White (2,451,007), McCracken et al (3,713,692), Rosenberg (4,235,474), Harlick et al (4,676,554) and Schrader et al (4,702,523). U.S. Pat. No. 4,428,514 to Elf discloses a device for use primarily as a carrier and secondarily for supporting a child on a chair.

However, the prior art is devoid of a device specifically adapted for supporting or holding a small child on a standard swing seat so as to allow a parent or other person to more easily and safely push the child without holding on to the child and thereby better enjoy the activity with the child. Consequently, there is a pressing need, left unfulfilled by the prior art, for a child restraint-type device which will serve this purpose.

SUMMARY OF THE INVENTION

The present invention provides a securing device and method for holding a child upright which is designed specifically to satisfy the aforementioned need. The child securing device of the present invention eliminates the necessity to hold on to the child while swinging him or her. The device has a simple construction, is easy to use, and is lightweight and convenient to transport to the locations of public or private standard swings. Unlike most of the prior art devices directed primarily to keeping a child on a stationary chair, the securing device of the present invention is directed primarily to keeping a child from falling from a moving swing seat.

Accordingly, the present invention is directed to a securing device for holding a child upright on a moving swing seat which comprises: (a) an elongated panel of flexible material, the panel having an intermediate portion extendable in forward-and-aft relation below a swing seat and front and rear portions connected to and extending in opposite directions from the intermediate portion, the front and rear panel portions being extendable upwardly from the front and rear of a swing seat and along the front and rear of a child seated on the swing seat and having respective outer ends located approximately at the elevation of the arm pits of the child seated on the swing seat; (b) means attached to the intermediate portion of the panel for anchoring the intermediate portion to the swing seat in underlying relation thereto between opposite lateral sides thereof; and (c) means attached to the respective outer ends of the front and rear panel portions for coupling the front and rear panel portions to a pair of vertically-extending flexible members supporting the swing seat at opposite lateral sides thereof for undergoing swinging motion. In such manner, the coupling means retains the front and rear panel portions in generally vertically-extending relation at the respective front and rear of the child for holding the child upright on the swing seat as the seat and child therewith undergo swinging motion.

More particularly, the anchoring means includes an elastic strap extendable in forward-and-aft relation above the swing seat opposite the intermediate panel portion extending below the swing seat. The strap is attached at one end to a first location on the intermediate panel portion. Also, the anchoring means includes means for detachably attaching an opposite end of the strap to a second location on the intermediate panel portion being spaced from the first location thereon. In the illustrated embodiment, the attaching means is a snap-type fastener having mating parts respectively independently attached on the opposite strap end and on the intermediate panel portion at the second location. The one end of the strap is attached to the intermediate panel portion so as to define a loop extending back over the one end thereof when attached at its opposite end to the second location on the intermediate panel portion by the attaching means. The strap has to be pulled from a relaxed condition to a stretched condition in order to fasten the fastener part thereon to the other fastener part on the intermediate panel portion.

Further, the coupling and retaining means is a tie member attached to and extending in opposite directions laterally from the outer end of each of the front and rear panel portions. Each tie member has opposite end portions adapted to be coupled to the vertical members supporting the swing seat and then tied in a square knot at the opposite side of the child.

The present invention is also directed to a securing method for so holding the child. The method comprises the steps of: (a) anchoring an intermediate portion of an elongated panel of flexible cloth material to an underside of a swing seat; (b) extending a rear portion of the elongated panel upwardly from the intermediate panel portion along the rear of a child seated on the swing seat; (c) coupling opposite end portions of a rear tie member, being attached to an outer end of the rear panel portion, to flexible members supporting the swing seat at opposite sides thereof and tying the rear tie member opposite ends portions in a knot at a front side of the child for retaining the rear panel portion in supporting relation along the rear of the child; (d) extending a front portion of the elongated panel upwardly from the intermediate panel portion along the front of the child seated on the swing seat; and (e) coupling opposite end portions of a front tie member, being attached to an outer end of the front panel portion, to the flexible members supporting the swing seat and tying the front tie member opposite ends portions in a knot at a rear side of the child for retaining the front panel portion in supporting relation along the front of the child. More particularly, the anchoring includes pulling a stretchable strap, being connected to the intermediate panel portion, forward-and-aft over the swing seat and detachably fastening it to the intermediate panel portion for holding the intermediate panel portion against the underside of the swing seat between the opposite sides thereof.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
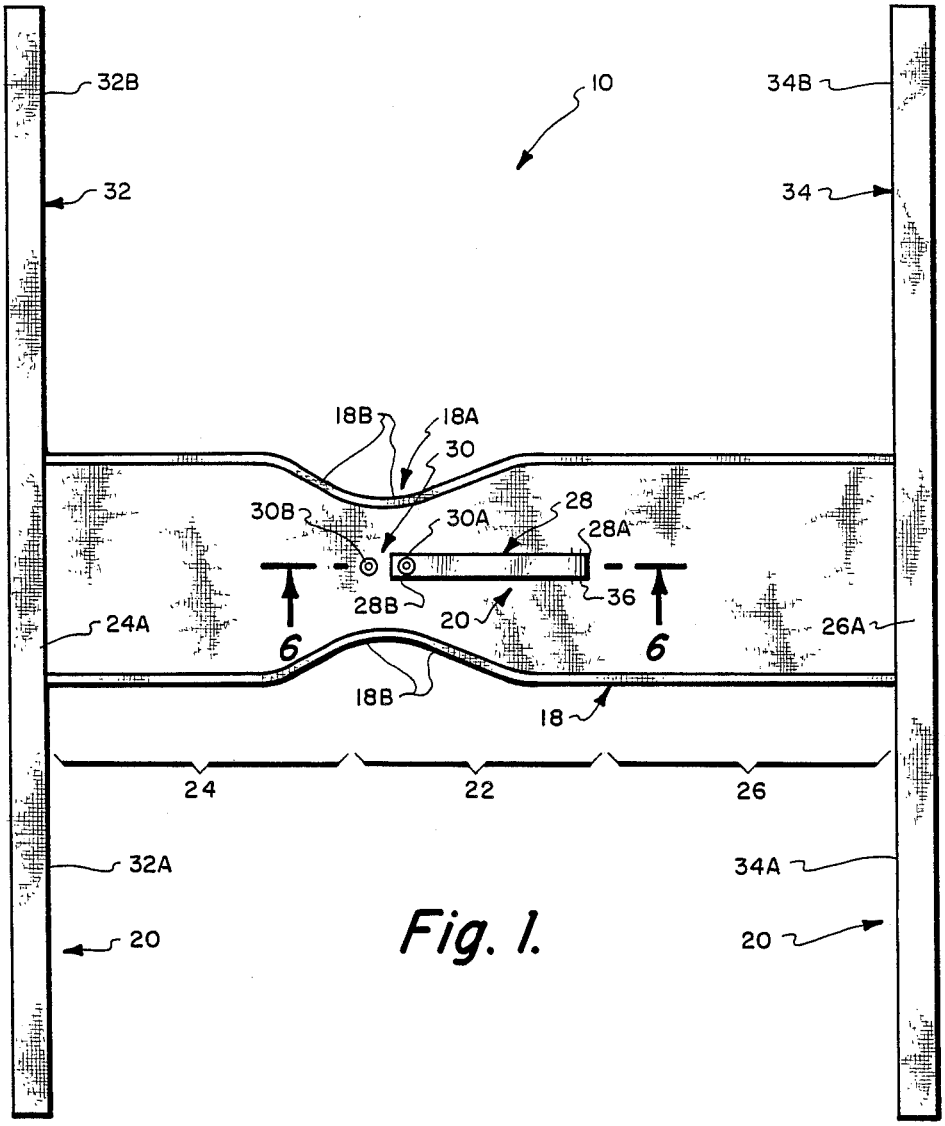
FIG. 1 is a top plan view of a securing device for holding a child upright on a swing seat in accordance with the present invention.
Figure 2:
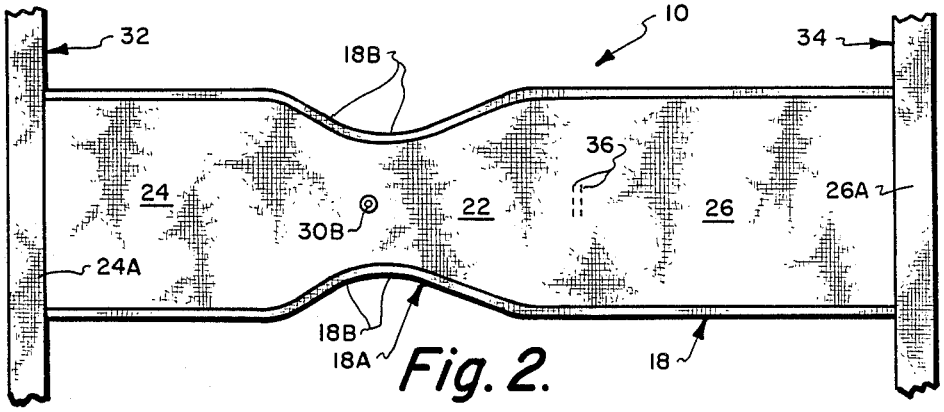
FIG. 2 is a fragmentary bottom plan view of the securing device.
Figure 3:
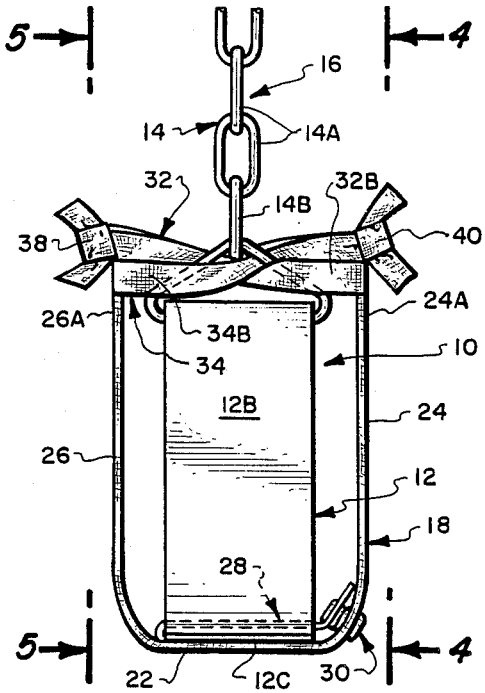
FIG. 3 is a side elevational view of the securing device of FIG. 1 in use with a swing seat.
Figure 4:
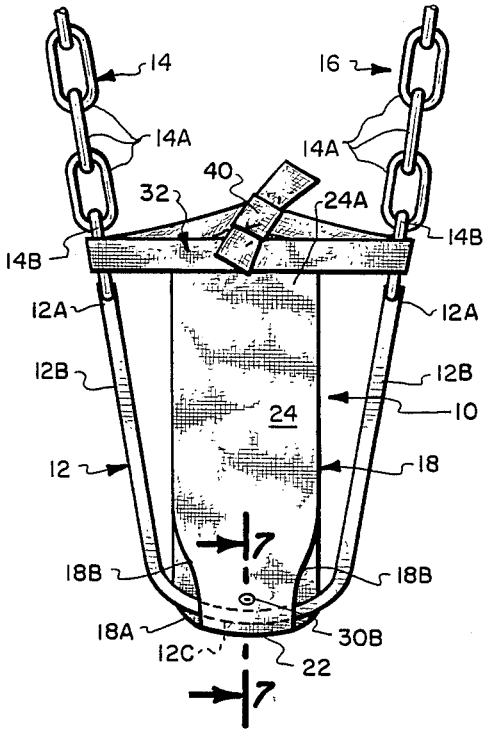
FIG. 4 is a front elevational view of the securing device as seen along line 4—4 of FIG. 3.
Figure 5:
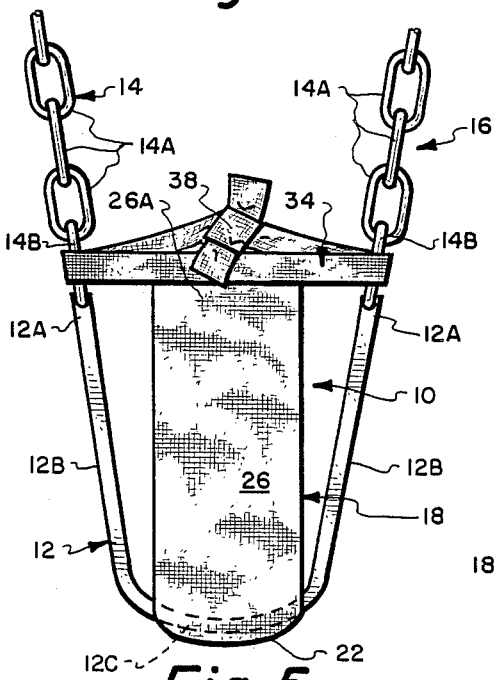
FIG. 5 is a rear elevational view of the securing device as seen along line 5—5 of FIG. 3.

Referring now to the drawings, and particularly to FIGS. 1–5, there is shown the preferred embodiment of a securing device, generally designated by the numeral 10, for holding a child (not shown) upright on a moving seat 12 supported at its opposite ends 12A by a pair of flexible suspension members 14, such as link-type chains, of a standard swing 16 without the requirement for assistance from a person pushing the child on the swing 16. Although the securing device 10 is illustrated in FIGS. 3–5 in conjunction with one common standard swing seat 12 which has a generally U-shaped configuration and is typically composed of stiff flexible rubber, the device 10 can also be employed with another common standard swing seat in the form of a rigid horizontal board or plate also supported by the suspension members at its opposite lateral ends or sides.

In its basic components, the securing device 10 includes an elongated panel 18 of flexible material, such as a suitable cloth, and means 20 for anchoring and attaching the panel 18 to the seat 12 and suspension members 14 of the swing 16. The panel 18 and straps 20 are preferably formed of a launderable fabric such as cotton, nylon, or cotton-polyester blends. The flexible panel 18 has intermediate, front and rear portions 22, 24 and 26. As can readily be seen in FIGS. 3 and 4, the intermediate panel portion 22 is extendable in forward-and-aft relation below the swing seat 12 generally at the middle of the seat. The front and rear panel portions 24, 26 are connected to and extend in opposite directions from the intermediate panel portion 22. As depicted respectively in FIGS. 4 and 5, the front and rear panel portions 24, 26 are extendable upwardly from the front and rear of the swing seat 12 and thus upwardly along the front and rear of the child (not shown) when seated thereon. The lengths of the front and rear panel portions 24, 26 are such that the respective outer ends 24A, 26A are located proximate the elevation of the arm pits of the child when seated on the swing seat.

The anchoring and attaching means 20 of the securing device 10 includes an elastic strap 28, a fastener 30, and a pair of front and rear tie members 32, 34. Referring in particular to FIGS. 1, 3, 6 and 7, the elastic strap 28 is attached at one end 28A, such as by sewn seams 36, on the upper surface of the intermediate panel portion 22 for anchoring the latter to the swing seat 12 in underlying relation thereto between opposite lateral sides thereof. The elastic strap 28 is extendable in forward-and-aft relation above the swing seat 12 opposite the intermediate panel portion 22 extending below the swing seat.

Figure 6:
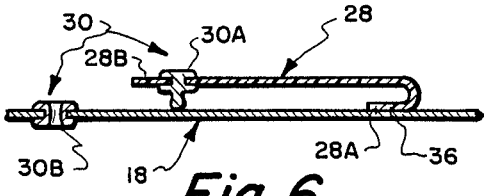
FIG. 6 is an enlarged fragmentary sectional view of the securing device taken along line 6—6 of FIG. 1.
Figure 7:
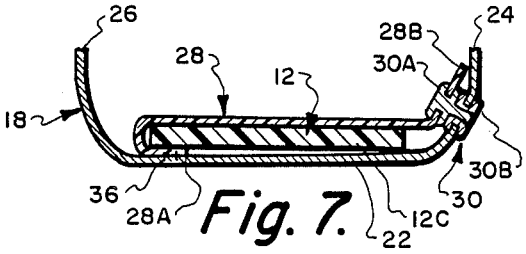
FIG. 7 is an enlarged fragmentary sectional view of the securing device and swing seat taken along line 7—7 of FIG. 4.

The fastener 30, in an exemplary form, is a conventional snap-type fastener with a pair of matable parts 30A, 30B respectively attached on the other end 28B of the strap 28 and on the intermediate panel portion 22. The fastener 30 is provided for detachably attaching the other end 28B of the strap 28 to the intermediate panel portion 22. As seen in FIGS. 1 and 6, the distance between the one end 28A of the strap 28 and the one fastener part 30A thereon is less than the distance between the one strap end 28A and the other fastener part 30B on the intermediate panel portion 22 such that the elastic strap 28 has to be stretched or pulled from a relaxed condition (FIG. 6) to a stretched condition (FIG. 7) in order to fasten the fastener part 30A thereon to the other fastener part 30B on the intermediate panel portion 22. The stretched strap 28 keeps the intermediate panel portion 22 from sliding laterally along the seat 12. Also, the one end 28A of the strap 28 is attached to the intermediate panel portion 22 so as to define the strap 28 in a loop, as seen in FIG. 6, extending back over the one end 28A thereof when the strap 28 is attached at its opposite end 28B to the intermediate panel portion 22 by the detachable fastener 30.

The front and rear flexible tie members 32, 34 of the securing device 10, also preferably composed of a suitable cloth, are attached such as by being sewn along the respective outer ends 24A, 26A of the front and rear panel portions 24, 26. The tie members 32, 34 are positioned at about the arm pit level of the child and are adapted to couple the front and rear panel portions to the suspension members 14 supporting the swing seat 12. Specifically, the tie members 32, 34 each has a pair of opposite end portions 32A, 32B and 34A, 34B which are threaded or inserted through either links 14A or brackets 14B of the suspension members 14 for coupling the tie members 32, 34 and thus the front and rear panel portions 24, 26 to the suspension members 14. Further, the opposite end portions 32A, 32B and 34A, 34B of the front and rear tie members 32, 34 have sufficient length to permit them to extend about the sides of the child and to be tied together to form respective rear and front knots 38, 40, as seen only in FIG. 3, (preferably square knots) at the opposite rear and front sides of the child. In such manner, the tie members 32, 34 are adapted for retaining the front and rear panel portions 24, 26 in generally vertically-extending relation, as seen in FIGS. 3–5, at the respective front and rear of the child for holding the child upright on the swing seat as the seat and child therewith undergo swinging motion.

In one possible method of using the securing device 10 for supporting and holding a child upright on the moving swing seat 12, the intermediate panel portion 22 is first anchored to the underside of the swing seat 12, afterwhich the child is placed on the swing seat. Such anchoring is carried out by pulling the stretchable strap 28, being connected to the intermediate panel portion 22, forwardly so as to extend it forward-and-aft over the swing seat 12 and detachably fasten it to the intermediate panel portion 22 for holding the intermediate panel portion against the underside of the swing seat 12 between the opposite sides thereof.

Next, the rear panel portion 26 is extended upwardly from the intermediate panel portion 22 in a supporting relation along the rear of the child seated on the swing seat 12. The opposite end portions 34A, 34B of the rear tie member 34 on the rear panel portion 26 are then threaded or looped forwardly through the swing brackets 14B for coupling the rear tie member opposite end portions thereto and then tied in a square front knot 40 at a front side of the child for retaining the rear panel portion 26 in the supporting relation along the rear of the child.

Finally, the front panel portion 24 is extended upwardly from the intermediate panel portion 22, between the legs of the child, into a supporting relation along the front of the child seated on the swing seat 12. The opposite end portions 32A, 32B of the front tie member 32 on the rear panel portion 24 are then threaded or looped rearwardly through the swing brackets 14B for coupling the front tie member opposite end portions 32A, 32B thereto and then tied in a square rear knot 38 at a rear side of the child for retaining the front panel portion 24 in the supporting relation along the front of the child.

As seen in FIGS. 1, 2 and 4, the intermediate and front panel portions 22, 24 merge together at a section 18A of the panel 18 having concave edges 18B for providing the panel with a smaller width at the section 18A for facilitating fitting between the legs of the child seated on the swing seat 12. Also, in FIGS. 1, 2 and 5, it will be noted that the rear panel portion 26 has a generally rectangular configuration. The sides 12B and arcuate bottom 12C of the seat 12 together with the front and rear panel portions 24, 26 form a tight pouch within which the child can be held independently in an upright manner.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

Having thus described the invention, what is claimed is:

1. A securing device for holding a child upright on a moving swing seat, said device comprising:

(a) an elongated panel of flexible material, said panel having an intermediate portion extendable in forward-and-aft relation below a swing seat and front and rear portions connected to and extending in opposite directions from said intermediate portion, said front and rear panel portions extendable upwardly from the front and rear of a swing seat and along the front and rear of a child seated on the swing seat, said front and rear panel portions having respective outer ends located proximate the elevation of the arm pits of the child seated on the swing seat;

(b) means attached to said intermediate portion of said panel for anchoring said intermediate portion to the swing seat in underlying relation thereto between opposite lateral sides thereof, said anchoring means including an elastic strap extendable in forward-and-aft relation above the swing seat opposite said intermediate panel portion extending below the swing seat, said strap being attached to one end to a first location on said intermediate panel portion; and means for detachably attaching an opposite end of said strap to a second location on said intermediate panel portion being spaced from said first location thereon; and (c) means attached to said respective outer ends of said front and rear penal portions being extendable about the child and flexible members supporting the swing seat for coupling said front and rear panel portions to the flexible members and thereby retaining said front and rear panel portions in generally vertically-extending relation at the respective front and rear of the child for holding the child upright on the swing seat as the seat and child therewith undergo swinging motion.

2. The securing device of claim 1 wherein said attaching means is a snap-type fastener having mating parts respectively independently attached on said opposite strap end and on said intermediate panel portion at said second location.

3. The securing device of claim 2 wherein the distance between said one end of said strap and the one fastener part thereon is less than the distance between said one strap end and the other fastener part on said intermediate panel portion such that said strap has to be pulled from a relaxed condition to a stretched condition in order to fasten said fastener part thereon to said other fastener part on said intermediate panel portion.

4. The securing device of claim 2 wherein said one end of said strap is attached to said intermediate panel portion so as to define said strap in a loop configuration extending back over said one end thereof when said strap is attached at its opposite end to said second location on said intermediate panel portion by said detachable attaching means.

5. The securing device of claim 1 wherein said coupling and retaining means is a tie member attached to, and having opposite end portions extending in opposite directions laterally from, said outer end of each of said front, and rear panel portions.

6. The securing device of claim 5 wherein said opposite end portions of each tie member are adapted to be coupled to the vertical members supporting the swing seat and then tied in a knot at the opposite side of the child.

7. The securing device of claim 1 wherein said rear panel portion has a generally rectangular configuration.

8. The securing device of claim 1 wherein said front and intermediate panel portions merge together at a section of said panel having concave edges for providing said panel with a smaller width at said section being for fitting between the legs of the child seated on the swing seat.

9. A securing device for holding a child upright on a moving swing seat, said device comprising:

(a) an elongated panel of flexible cloth material, said panel having an intermediate portion extendable in forward-and-aft relation below a swing seat and front and rear portions connected to and extending in opposite directions from said intermediate portion, said front and rear panel portions extendable upwardly from the front and rear of a swing seat and along the front and rear of a child seated on the swing seat, said front and rear panel portions having respective outer ends located proximate the elevation of the arm pits of the child seated on the swing seat;

(b) an elastic strap attached at one end to a first location on said intermediate panel portion for anchoring said intermediate panel portion to the swing seat in underlying relation thereto between opposite lateral sides thereof, said strap being extendable in forward-and-aft relation above the swing seat opposite said intermediate panel portion extending below the swing seat;

(c) means for detachably attaching an opposite end of said strap to a second location on said intermediate panel portion being spaced from said first location thereon; and (d) front and rear means attached to the respective outer ends of said front and rear panel portions being extendable about the child and flexible members supporting the swing seat at opposite sides thereof for coupling said front and rear panel portions to the flexible members, said front and rear means for forming knots at opposite rear and front sides of the child for retaining said front and rear panel portions in generally vertically-extending relation at the respective front and rear of the child and thereby holding the child upright on the swing seat as the seat and child therewith undergo swinging motion.

10. The securing device of claim 9 wherein said detachable attaching means is a snap-type fastener having mating parts respectively independently attached on said opposite strap end and on said intermediate panel portion at said second location.

11. The securing device of claim 10 wherein the distance between said one end of said strap and the one fastener part thereon is less than the distance between said one strap end and the other fastener part on said intermediate panel portion such that said strap has to be pulled from a relaxed condition to a stretched condition in order to fasten said fastener part thereon to said other fastener part on said intermediate panel portion.

12. The securing device of claim 10 wherein said one end of said strap is attached to said intermediate panel portion so as to define said strap in a loop configuration extending back over said one end thereof when said strap is attached at its opposite end to said second location on said intermediate panel portion by said detachable attaching means.

* * * * *